US006866363B2

(12) United States Patent
Oku

(10) Patent No.: US 6,866,363 B2
(45) Date of Patent: Mar. 15, 2005

(54) WASTE INK COLLECTING DEVICE

(75) Inventor: Nobuaki Oku, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/417,094

(22) Filed: Apr. 17, 2003

(65) Prior Publication Data

US 2003/0202038 A1 Oct. 30, 2003

(30) Foreign Application Priority Data

Apr. 24, 2002 (JP) ..... 2002-121682

(51) Int. Cl.[7] ..... B41J 2/165
(52) U.S. Cl. ..... 347/36; 347/31; 347/35
(58) Field of Search ..... 347/22, 23, 29, 347/35, 36

(56) References Cited

U.S. PATENT DOCUMENTS

| | | | | |
|---|---|---|---|---|
| 4,524,365 A | | 6/1985 | Kakeno et al. | |
| 5,113,206 A | * | 5/1992 | Fukazawa | 347/86 |
| 5,680,162 A | * | 10/1997 | Taylor et al. | 347/35 |
| 6,203,137 B1 | * | 3/2001 | Niimura et al. | 347/36 |
| 6,659,587 B2 | * | 12/2003 | Berg et al. | 347/36 |

FOREIGN PATENT DOCUMENTS

| | | |
|---|---|---|
| EP | 0323262 A | 7/1989 |
| EP | 0841175 A | 5/1998 |
| JP | 03227658 | 10/1991 |
| JP | A 9-85965 | 3/1997 |
| JP | A 2000-85145 | 3/2000 |
| JP | 2000-203058 | 7/2000 |
| JP | A 2001-171148 | 6/2001 |
| WO | WO 91/04156 | 4/1991 |

OTHER PUBLICATIONS

European Search Report, DeGroof, R Aug. 13, 2003, EP03 00 9014.

* cited by examiner

*Primary Examiner*—Shih-Wen Hsieh
(74) *Attorney, Agent, or Firm*—Oliff & Berridge PLC

(57) ABSTRACT

A waste ink collecting device has an ink tank accommodating an ink absorber that absorbs unnecessary ink discharged from a printhead of an ink-jet printer. The discharged ink is dropped onto the ink tank. An inlet of the dropped ink is formed on a top plate of the ink tank, and the dropped ink enters the ink tank through the inlet. The ink tank has a partition wall that defines, inside the partition wall, a passage of the ink entered through the inlet to an inner bottom surface of the ink tank. The partition wall prevents the dropped ink from directly striking the ink absorber. The ink dropped on the inner bottom surface of the ink tank is absorbed by the ink absorber through a bottom surface thereof.

23 Claims, 7 Drawing Sheets

WASTE INK COLLECTING DEVICE

BACKGROUND OF THE INVENTION

The present invention relates to a waste ink collecting device which collects waste ink discharged and/or sucked through a waste ink nozzle of a printhead of an inkjet printer.

Conventionally, in an inkjet printer for personal use, a waste ink collecting chamber is defined inside the main body of the inkjet printer to collect waste ink, which is discharged by or sucked from an printhead when cleaning of the printhead is performed, ink cartridges are to be exchanged and the like. The waste ink is dropped onto the waste ink collecting chamber accommodating ink absorbers for absorbing the dropped ink. Typically, in the inkjet printers for personal use, the amount of printing is relatively small, the quantity of the waste ink absorbed by the ink absorbers during its product life is relatively small. Therefore, the quantity of the waste ink throughout the product life of the printer hardly exceeds the capacity (i.e. absorbable quantity) of the ink absorber, and it is generally not necessary to exchange the ink absorber. Therefore, in the personal-use inkjet printer, the waste ink collecting chamber is configured such that the ink absorber is not replaced.

In a business-use inkjet printer whose printing amount is relatively large and/or in a commercial-use inkjet printer such as one for printing a poster or dress fabric having a relatively wide printing area, the frequency of cleaning operations increases.

That is, in the business-use inkjet printer, the quantity of the ink consumed is relatively large. Further, when the printing is carried out on the dress fabric, due to diversification of fabric material, various fabric dust may adhere on an inner surface of each nozzle of the printhead. Furthermore, the heat generated due to the increase of printing load causes air bubbles within the ink inside the printhead, which affects ejection of the ink from the nozzles of the printhead. Therefore, it becomes necessary to carry out the cleaning of the printhead frequently. As the frequency of the cleaning increases, the quantity of the waste ink increases.

An example of a conventional waste ink collecting device for such a business-use and/or commercial-use inkjet printer will be described with reference to FIG. 9.

FIG. 9 is a cross-sectional view of a conventional waste ink collecting device 20. The waste ink collecting device 20 is configured such that the waste ink is dropped from the above portion thereof. At a time when the cleaning of a printhead (not shown) is carried out, the waste ink discharged from or sucked through nozzles of the printhead is fed to a discharging tube 23, and is further fed to a dropping tube 25 via a discharging pump 24 (the discharging tube may be omitted when the waste ink is dropped by gravity). As shown in FIG. 9, the dropping tube 25 is located immediately above an opening 26 formed on a waste ink tank 21. The waste ink collecting device 20 has the waste ink tank 21 and an ink absorber 22 made of material having a high absorption rate such as felt, bonded-fiber fabric or the like. The ink absorber 22 is formed to have a shape of a substantially rectangular solid so as to fit the inner shape of the waste ink tank 21. As shown in FIG. 9, the waste ink dropped from the dropping tube 25 directly strikes the ink absorber 22 through the opening 26, and is absorbed by the ink absorber 22. Although not shown in FIG. 9, the waste ink tank 21 may be provided with an openable cover structure so that the ink absorber 22 can be exchanged with a new one when necessary.

FIG. 10 shows another example of a conventional waste ink collecting device, which is disclosed in Japanese Patent Provisional Publication No. HEI 09-085965. In FIG. 10, the members similar to those in FIG. 9 have the same reference numbers. In this example, the upper surface of the ink absorber 22 is inclined, and the waste ink from the dropping tube 26 drop on the higher side (i.e., right-hand side in FIG. 10) of the ink absorber 22. In this example, since the ink absorber 22 is configured such that a portion where the waste ink drops is higher (thicker) and a portion further therefrom is lower (thinner), the ink dropped on the higher portion is absorbed by the higher portion initially, and then permeates/spreads to lower portions gradually.

In the first example (FIG. 9), the waste ink permeates the waste ink absorber 22 downward from a position at which the waste ink drops. Since the upper surface of the ink absorber 22 extends substantially horizontally, the dropped ink hardly permeates the ink absorber 22 in the horizontal direction. Thus, according to the configuration of the first example, the entire volume of the ink absorber 22 is not used efficiently, and the waste ink concentrates at portions within a certain area centering around the portion where the ink drops.

In the second example (FIG. 10), since the upper surface of the ink absorber 22 inclines with respect to the horizontal direction, the dropped ink permeates along the upper surface of the ink absorber 22. However, in this configuration, since the portion at which the ink drops is located at the end portion of the ink absorber 22, a distance from the position where the ink drops to the end portion of the ink absorber 22 is relatively long. Accordingly, the end portion of the ink absorber 22 tends to absorb the ink insufficiently. Therefore, also in this case, the entire volume of the ink absorber 22 may not be used efficiently.

Further to the above defect, according to the structure of the first and second examples, the upper surface of the ink absorber 22 faces the opening 26. Therefore, the waste ink absorbed by the ink absorber 22 may easily evaporate from the upper surface of the ink absorber, in particular, at a portion facing the opening 26. When the ink evaporates, the residual material of the waste ink is condensed, which weaken the absorption property of the ink absorber 22.

SUMMARY OF THE INVENTION

The present invention is advantageous in that an improved waste ink collecting device which enables the ink absorber to efficiently absorb the ink dropped thereon.

According to an aspect of the invention, there is provided a waste ink collecting device having an ink tank accommodating an ink absorber that absorbs unnecessary ink discharged from a printhead of an ink-jet printer. The discharged ink is dropped onto the ink tank. An inlet of the dropped ink is formed on a top plate of the ink tank, the dropped ink enters the ink tank through the inlet. The ink tank has a partition wall that defines, inside the partition wall, a passage of the ink entered through the inlet to an inner bottom surface of the ink tank. The partition wall prevents the dropped ink from directly striking the ink absorber. The ink dropped on the inner bottom surface of the ink tank is absorbed by the ink absorber through a bottom surface thereof.

Optionally, the partition wall is protruded downward from an inner surf ace of a top plate of the ink tank, or the partition wall may be protruded upward from an inner bottom surface of the ink tank.

Optionally, at least one waste ink outlet opening is formed on a lower portion of the partition wall, the passage defined inside the partition wall communicating through the at least one waste ink outlet opening with an area outside the partition wall and on the inner bottom surface of the ink tank.

Further optionally, at least an area of the inner bottom surface of the ink tank where the ink is dropped is formed to have a higher level than an other area of the inner bottom surface.

In a particular case, a plurality of ribs may be formed on the inner bottom surface of the ink tank such that one end of each rib is located in the vicinity of an area where the ink is dropped, each of the plurality of ribs extending toward peripheral area of the inner bottom surface.

In some embodiments, the ink tank is provided with an openable upper cover, the upper cover compressing the ink absorber when the upper cover is closed, the compression being released when the upper cover is opened.

In a certain case, the ink tank may be provided with an upper cover which is openable with respect to a main body of the ink tank, the ink tank can be oriented vertically when being transported, and borders between the main body of the ink tank and the upper cover being located at positions spaced from a bottom portion when the ink tank is oriented vertically so as to prevent leakage of the ink pooled at the bottom portion.

Further optionally, the ink tank is formed with at least an area which allows a user to observe a condition of the ink absorber.

BRIEF DESCRIPTION OF THE ACCOMPANYING DRAWINGS

DETAILED DESCRIPTION OF THE EMBODIMENTS

Hereinafter, with reference to FIGS. 1 through 8, waste ink collecting devices according to embodiments of the invention will be described.

Figure 1:
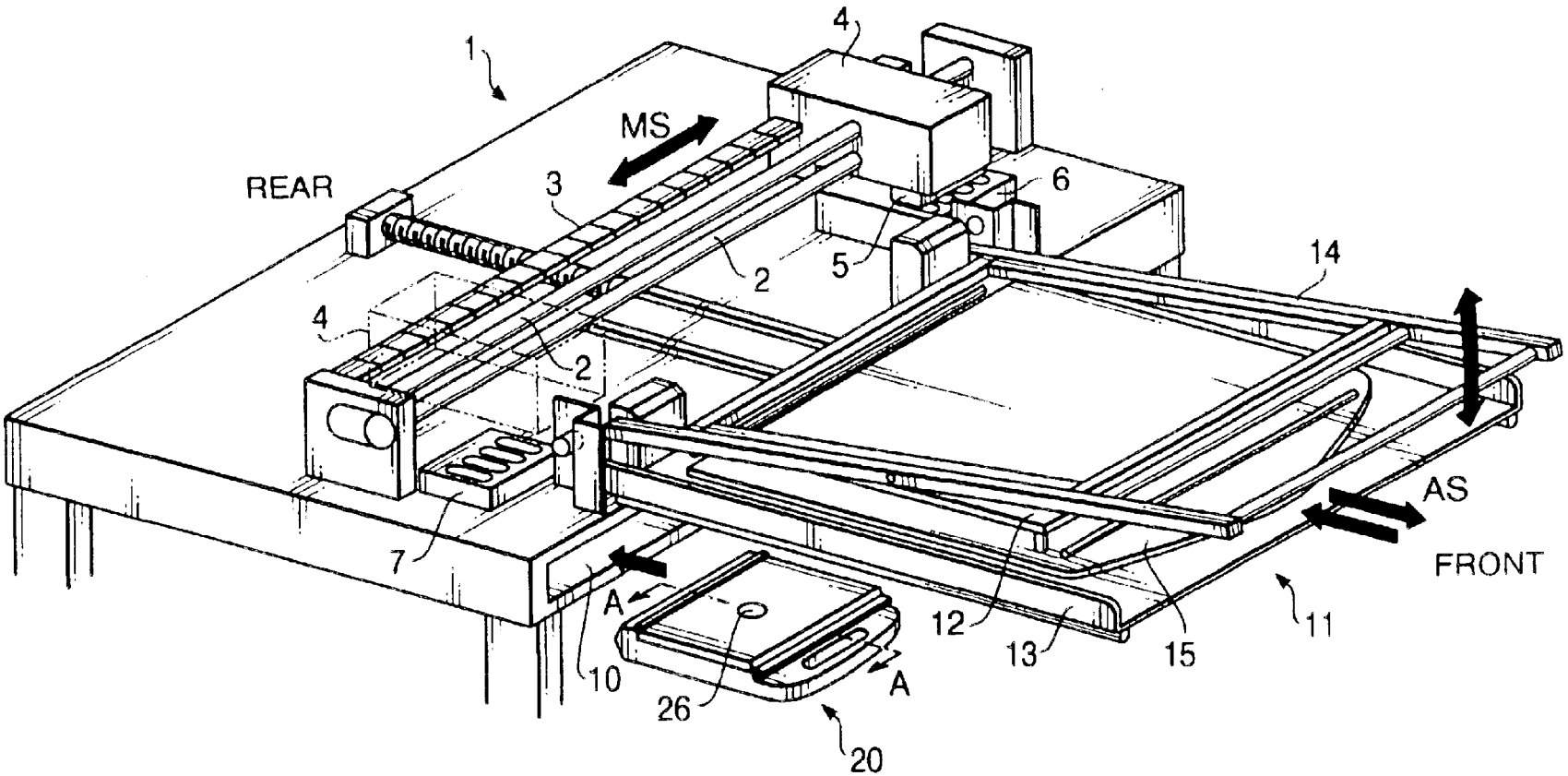
FIG. 1 is a perspective view of an inkjet printer employing a waste ink collecting device according to the invention is applicable.

FIG. 1 is a perspective view of an inkjet printer 1 in which the waste ink collecting devices according to the embodiments can be employed.

As shown in FIG. 1, the exemplary inkjet printer 1 includes carriage 4 provided with a printhead 5 and one or more shafts along which the carriage moves reciprocally in a main sweeping direction (indicated by arrow MS). The printer 1 also includes an ink cartridge (now shown).

a drive belt 3 which is connected with the carriage 4 and transmits the driving force to the carriage 4 and a cleaning unit 6 which performs a cleaning operation for the printhead 5 at a predetermined interval when the printhead 5 is located in its initial position. The initial position is a right-hand side end position, as shown in FIG. 1. Further a purge unit 7 which purges the printhead 5 by discharging unnecessary ink from the printhead 5 when the printhead 5 is located at the left-hand side end, as indicated by dotted lines in FIG. 1.

A waste ink collecting device 20 is provided. The waste ink collecting device 20 has an opening 26 into which the waste ink discharged through the cleaning unit 6 and/or purge unit 7 is dropped.

A reception opening 10 in which the waste ink collecting device 20 is placed and an insertion guide plate 15 for guiding material such as bag-formed cloth subject to be printed are also included in the printer. The printer 1 also includes a platen unit 11 including a platen 12 on which the material (cloth or the like) is placed, a platen tray 13 which prevents the side portions of the material from trailing down, and a holding frame 14 which holds the material onto the platen 12.

Next, the operation of the inkjet printer 1 will be described.

When a platen unit actuation switch (not shown) is operated by a user, the platen unit 11 slides from its retracted position (print start position) to a material setting position, which is shown in FIG. 1, and is stopped thereat. When the platen unit 11 is located at the material setting position, the user can lift the holding frame 14 upward, place the material such as the cloth on the platen 12, and then lift down the holding frame 14 so that the material (e.g. cloth) is fixed onto the platen 12.

Thereafter, when the user operates a print start switch (not shown), the platen unit 11 carrying the material subject to be print slides backward to the print start position. When the platen unit 11 reaches the print start position, the carriage 4 start moving reciprocally in the main sweeping direction and drops of inks are discharged from the nozzles of the printhead 5 onto the material, thereby the printing being performed. According to this exemplary embodiment, when the carriage 4 completes one reciprocating motion, the platen unit 11 moves in an auxiliary sweeping direction (i.e., a direction perpendicular to the main sweeping direction: indicated by arrows AS) by one step, and then the printing in the next main sweeping direction is performed. By repeating the above operation, the printing is performed on a two-dimensional area on the material.

The printhead 5 has nozzles corresponding to a plurality of color inks. During the printing operation described above, the color inks are supplied from a plurality of ink cartridge to the respective nozzles through ink supplying paths defined in the printhead in accordance with print data. The waste ink discharged or sucked from the printhead 5 when the cleaning is performed is fed through waste ink path (not shown) and is dropped in the opening 26 of the waste ink collecting device 20 through a waste ink discharge tube (not shown) arranged above the opening 26 of the waste ink collecting device 20, which is inserted in the inkjet printer 1. Similarly, the waste ink discharged when the printhead 5 is purged is also dropped into the opening.

First Embodiment

Figure 2A:
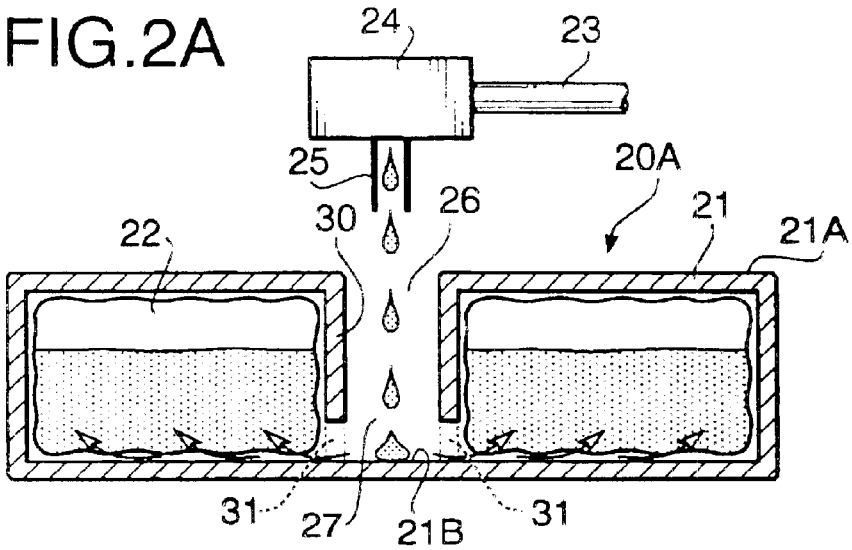
FIG. 2A is a cross-sectional view of the waste ink collecting device according to a first embodiment.

FIG. 2A is a cross-sectional view of the waste ink collecting device 20A according to a first embodiment of the invention. As shown in FIG. 2A, a partition wall 30 is protruded from an inner surface of the top plate of a waste ink tank 21. FIG. 2C is a perspective view showing the partition wall 30 of the waste ink collecting device 20A shown in FIG. 2A.

According to the first embodiment, the opening 26 is formed on a top surface 21A of the ink tank 21 substantially at the center portion thereof, as shown in FIG. 1. Inside the waste ink tank 21, the ink absorber 22 is provided as shown in FIG. 2A. Below the opening 26, a cylindrical partition wall 30 is formed to define a waste ink passage 27 such that the ink absorber 22 is not exposed to outside through the opening. Thus, the ink absorber 22 is enclosed in a chamber defined by the inner surfaces of the ink tank 21 and the partition wall 30. The lower end of the partition wall 30 is spaced from the inner bottom surface 21B of the ink tank 21 to define a clearance which functions as a waste ink outlet 31, through which the waste ink dropped through the waste ink passage 27 flows toward the chamber enclosing the ink absorber 22.

With the structure described above, the waste ink dropped from the dropping tube 25 does not directly strike the ink absorber 22, but is dropped inside the cylindrical partition wall 30, flows toward the ink absorber 22 via the waste ink outlet 31, and is absorbed by the ink absorber 22. Generally, there are lots of fabric threads on the outer surface of the ink absorber 22, a certain space is kept between the lower surface of the ink absorber 22 and the inner bottom surface 21B of the ink tank 21. Accordingly, the waste ink flowing through the waste ink outlet 31 does not stay at a position where it dropped, but flows toward the peripheral of the ink absorber 22, and is absorbed by the ink absorber 22.

Figure 2B:
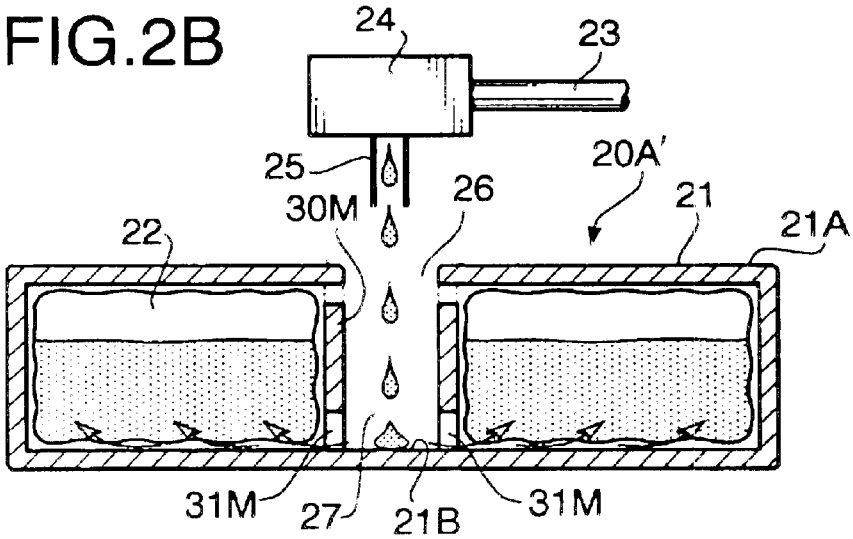
FIG. 2B is a cross-sectional view of the waste ink collecting device according to a modified first embodiment.
Figure 2C:
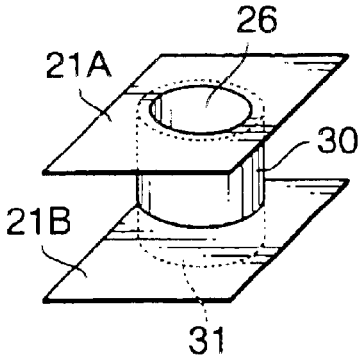
FIG. 2C is a perspective view showing a partition of the waste ink collecting device shown in FIG. 2A.
Figure 2D:
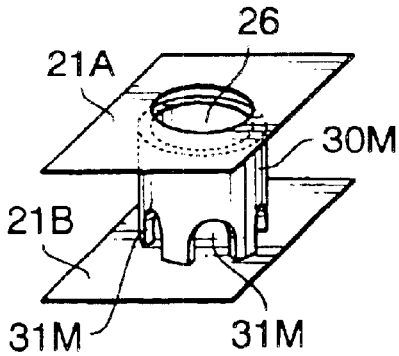
FIG. 2D is a perspective view showing a partition of the waste ink collecting device shown in FIG. 2B.

It should be noted that a partition wall 30M may be formed to protrude from the bottom surface 21B of the ink tank 21 as in a modified waste ink collecting device 20A' shown in FIG. 2B. In this case, a plurality of waste ink outlets 31M may be formed at the lower end of the partition wall 30M as shown in FIG. 2D.

In some cases, a sufficient clearance cannot be formed between the lower surface of the ink absorber 22 and the inner bottom surface 21B of the ink tank 21 and/or the waste ink has a relatively high viscosity and may not flow toward the peripheral portion of the lower surface of the ink absorber 22 smoothly. In such a case, it is preferable that the structure of the ink collecting device is modified as shown in FIG. 3.

Second Embodiment

Figure 3:
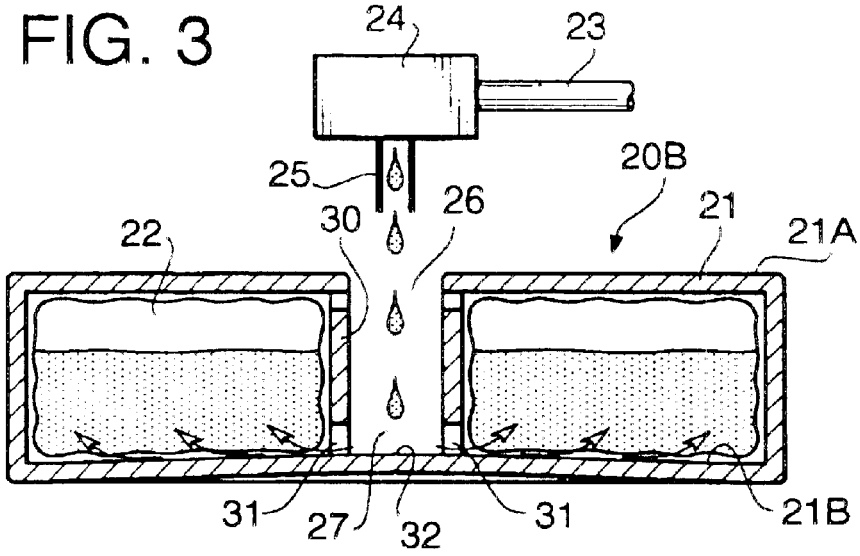
FIG. 3 is a cross-sectional view of the waste ink collecting device according to a second embodiment.

FIG. 3 is a cross-sectional view of the waste ink collecting device 20B according to a second embodiment. The structure of the waste ink collecting device 20B is substantially the same as the waste ink collecting device 20A' shown in FIG. 2B except that the central portion 32 of the inner bottom surface 21B has a higher level than the outer portion thereof so that the ink dropped at the central portion 32 of the bottom surface 21B is easy to flow toward the peripheral area. It should be noted that this structure of the bottom surface 21B can apply to the waste ink collecting device 20A shown in FIG. 2A. Alternatively or optionally, a protrusion may be formed at the central portion 32 to achieve a similar effect. It should also be noted that a level difference between the central portion 32 and the peripheral area can be made by gradually changing the level (height) stepwise or continuously.

Third Embodiment

Figure 4A:
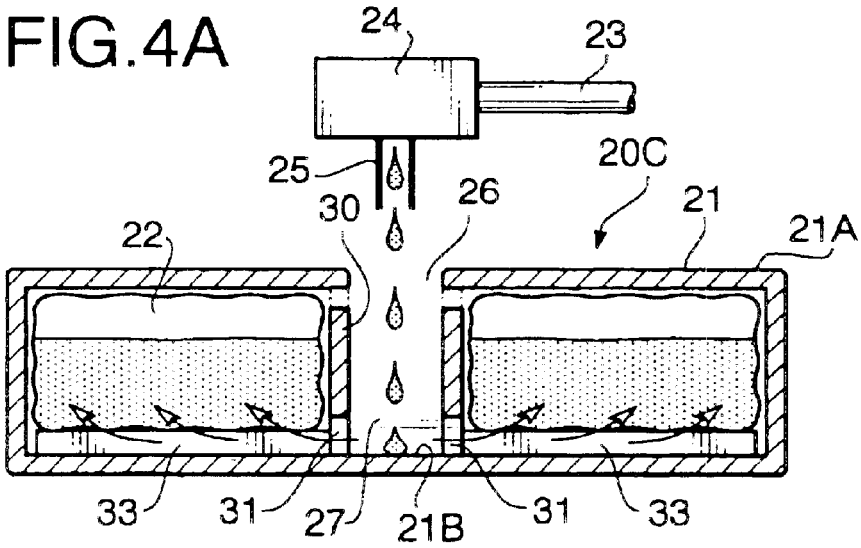
FIG. 4A is a cross-sectional view of the waste ink collecting device according to a third embodiment.
Figure 4B:
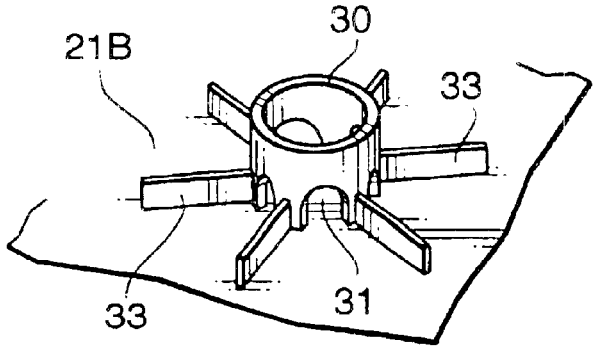
FIG. 4B is a perspective view showing a plurality of ribs employed in the waste ink collecting device.

FIG. 4A is a cross-sectional view of a waste ink collecting device 20C according to a third embodiment, and FIG. 4B is a perspective view showing the partition wall 30 and a plurality of ribs employed in the waste ink collecting device 20C. The structure of the waste ink collecting device 20C is similar to the waste ink collecting device 20A' shown in FIGS. 2B and 2D except that a plurality of ribs 33 are provided as shown in FIGS. 4A and 4B. Specifically, the plurality of the ribs are provided on the bottom surface 21B of the ink tank 21 and extend in radial directions from the outer circumferential surface of the partition wall 30 to the peripheral side end of the absorber 22. Since the plurality of ribs 33 are located between the ink absorber 22 and the inner bottom surface 21B of the ink tank 21, an appropriate clearance can be formed therebetween, which enables the waste ink dropped on the inner bottom surface 22B through the ink passage 27 to flow toward the peripheral portion easily. It should be noted that the plurality of ribs can be employed in the structure shown in FIG. 2A.

Fourth Embodiment

Figure 5:
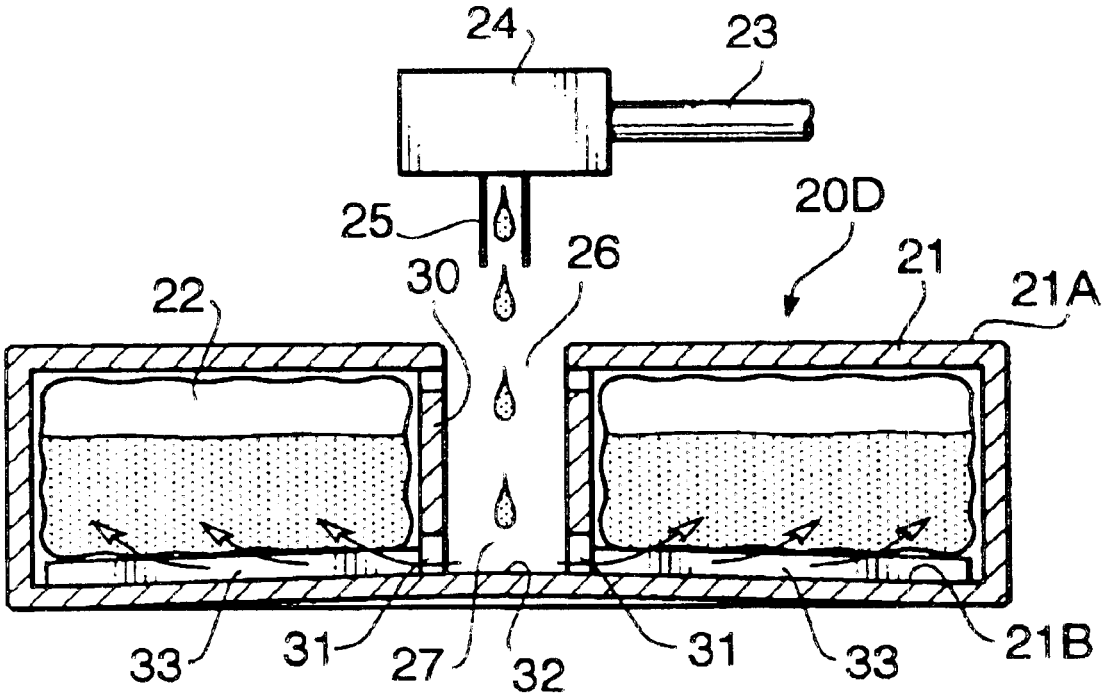
FIG. 5 is a cross-sectional view of the waste ink collecting device according to a fourth embodiment.

FIG. 5 is a cross-sectional view of a waste ink collecting device 20D according to a fourth embodiment of the invention. This embodiment is configured as a combination of the second embodiment and third embodiment. That is, as shown in FIG. 5, the central portion of the inner bottom surface 21B has a higher level than the peripheral areas, and further, a plurality of ribs extending from the central portion to the peripheral portion of the inner bottom surface 21B are provided on the inner bottom surface 21B. With this configuration, since the ribs 33 are provided, an appropriate clearance is defined between the inner bottom surface 21B and the lower surface of the ink absorber 22. Further, due to the level difference between the central portion and the peripheral portion of the inner bottom surface 21B, the ink flows form the central are to the peripheral area of the inner bottom surface 21B relatively easily.

Fifth Embodiment

Figure 6A:
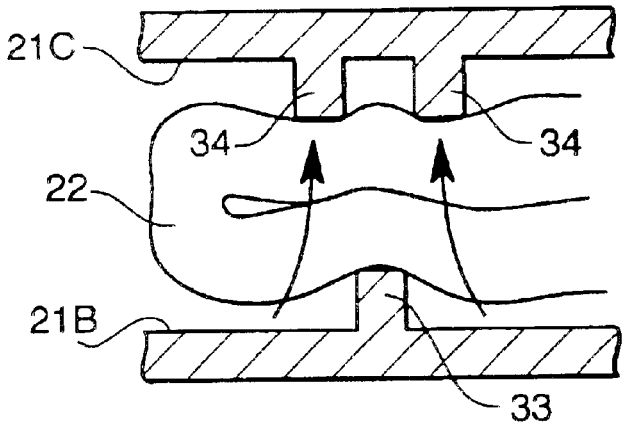
FIG. 6A is a partial cross-sectional view of the waste ink collecting device according to a fifth embodiment.
Figure 6B:
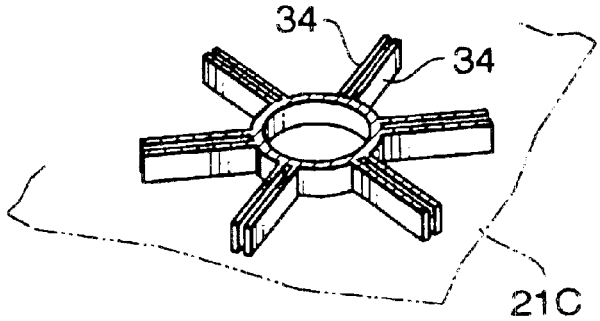
FIG. 6B is a perspective view showing pressure ribs.
Figure 6C:
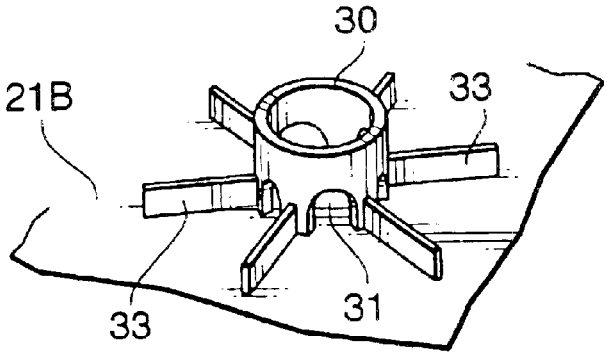
FIG. 6C is a perspective view showing ribs.

FIG. 6A is a partial cross-sectional view of the waste ink collecting device 20E according to a fifth embodiment. FIG. 6B is a perspective view showing pressure ribs 34, and FIG. 6C is a perspective view showing ribs 33.

Generally, the ink absorber provided in the ink tank 21 is formed by folding an ink absorbing sheet having a predetermined thickness. If the folded ink sheet is placed in the ink tank 21 of the waste ink collecting device 20A, 20B, 20C or 20D described above, there would be an unnecessary clearance between the surfaces of the folded portions facing each other. When such a clearance is formed, a capillary phenomenon is discontinuous at the clearance in the midst of the ink absorber in the vertical direction. Accordingly, when the waste ink located beneath the ink absorber 22 is absorbed, the ink may not permeate sufficiently in the upper portion of the folded ink absorber 22.

In order to avoid such a problem, according to the fifth embodiment, the ink tank 21 is configured such that the ribs 33, as employed in the third and fourth embodiment, are provided (see FIG. 6A). Further, as shown in FIG. 6B, pressing ribs 34 are formed, at positions, corresponding to the ribs 33, on an inner top surface 21C of the ink tank 21, the pressing ribs 34 slightly pressing the ink absorber 22 such that the ink absorber 22 is nipped between the pressing ribs 34 and the ribs 33.

With such a structure, the facing surfaces of the folded ink absorber 22 are forcibly contacted with each other. Therefore, the capillary phenomenon across the ink absorber in the thickness direction (i.e., the vertical direction) will not be retained, and thus the deterioration of the absorbability can be prevented.

Even when the absorber 22 is not a folded one, by applying partial and slight urging force from upper side and lower side thereof, when the upper cover of the ink tank 21 is opened for exchanging the ink absorber 22, for example, the upper portion of the ink absorber 22 tends to inflate, which causes a negative pressure temporarily, thereby the ink pooled unabsorbed on the bottom of the ink tank 21 is absorbed by the ink absorber 22. That is, when the ink absorber 22 is exchanged, by configuring the ink tank 21 as described above, the unabsorbed ink can be absorbed by the ink absorber 22 effectively.

Sixth Embodiment

An waste ink collecting device 20F according to a sixth embodiment of the invention will be described.

Figure 7A:
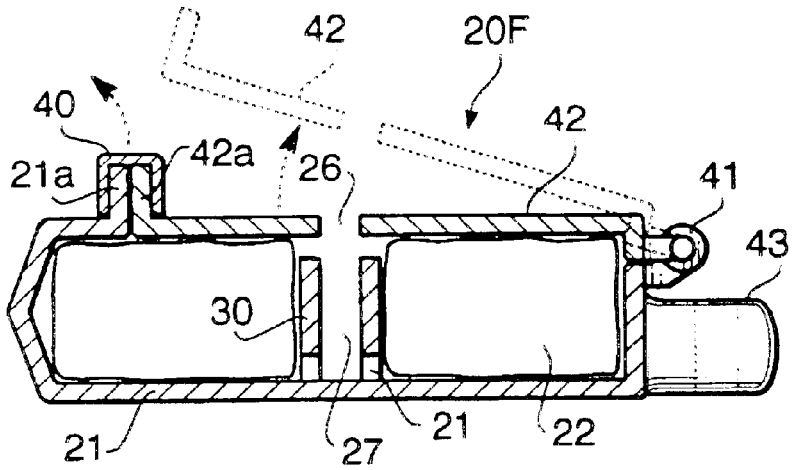
FIG. 7A shows a waste ink collecting device according to a sixth embodiment in a horizontally placed state.
Figure 7B:
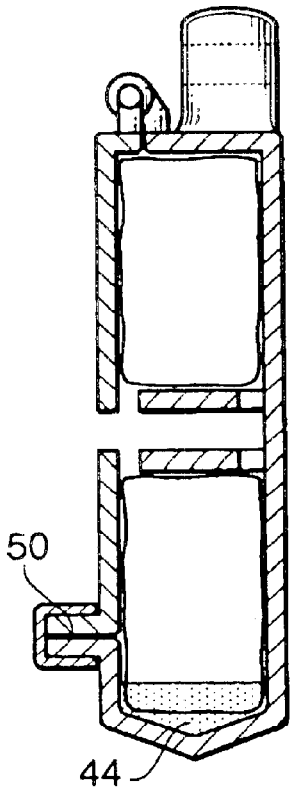
FIG. 7B shows the waste ink collecting device according to the sixth embodiment in a vertically oriented state.

FIG. 7A and FIG. 7B show the waste ink collecting device 20F according to the sixth embodiment in horizontal and vertically oriented state, respectively.

When the ink absorber 22 is exchanged, the waste ink collecting device 20F is removed from the ink-jet printer, and in some cases, orientation of the waste ink collecting device 20 may be varied when the waste ink collecting device 20 is carried to a place where the ink absorber 22 is replaced. In particular, when a handle is provided to the waste ink collecting device 20F, it may be oriented vertically as shown in FIG. 7B. For another example, when the ink absorber 22, whose size in a vertical direction is longer than the size in the horizontal direction, is exchanged, the waste ink collecting device is typically configured such that the device is placed horizontally, and the upper cover is opened to allow the accommodated ink absorber 22 to be removed. This type of waste ink collecting device provided with the openable upper cover requires a water-resistant packing member which prevents leakage of the waste ink out of the waste ink collecting device 20F when it is being transported. In such a device, the packing having a high water resistance is provided between the main body and the upper cover of the waste ink collecting device 20F so that the waste ink will not leak therefrom.

However, even if the waste ink collecting device 20*f* is configured as above, it may be difficult to completely prevent the leakage of the waste ink from the waste ink collecting device 20F. Further, additional packing members or the like requires the additional manufacturing cost.

It should be noted that each of FIG. 7A and FIG. 7B is a view taken along line A—A indicated in FIG. 1.

The waste ink collecting device 20F shown in FIG. 7A includes the ink tank 21 and the ink absorber 22. The waste ink collecting device 20F is further provided with an upper cover 42 and a handle 43.

As shown in FIG. 7A, the ink tank 21 is formed with a protruded elongated area 21*a*, which extends in a direction perpendicular to a plane of FIG. 7A, and corresponding to the protruded elongated area 21*a*, a protruded elongated area 42*a* is formed on the upper cover 42. In FIG. 7A, 40 denotes a locking member having a U-shaped cross-section along a plane parallel with the plane of FIG. 7A and elongated in the direction perpendicular to the plane of FIG. 7A.

Similarly to the above-described embodiments, the opening 26 is formed on the upper cover 42 at the central area thereof. When the ink collecting device 20F is inserted in the ink-jet printer, the upper cover 42 is closed, and is locked by the locking member 40 so as not to open. The drops of the waste ink are dropped from a portion above the opening 26.

When the ink absorber 22 is exchanged, the waste ink collecting device 20 is placed horizontally, and the upper cover 42 is opened such that the it swings about a pivot 41, as indicated by broken lines in FIG. 7A.

When the upper cover 42 is closed, the ink absorber 22 is slightly compressed, and when the upper cover 42 is opened, the ink absorber 22 is released from the compressing force. With this configuration, even though the ink absorber 22 is a folded structure as shown in FIG. 6A, when the upper cover 42 is closed, facing surfaces of the folded ink absorber 42 closely contact, and the capillary phenomenon is continuous across the entire ink absorber 22. Thus, the absorbing property will not be deteriorated. Further, when the upper cover 42 is opened for exchanging the ink absorber 22, since the compressing force is released, the ink absorber momentarily inflates, which causes the ink absorber 22 to absorb the residual ink pooled on the bottom of the ink tank 21.

When the waste ink collecting device 20F is carried, a user may grasp the handle 43 and the waste ink collecting device 20F is oriented substantially vertically as shown in FIG. 7B. In such a case, the ink may seep out of the ink absorber 22 due to the gravity, and an ink pool may be formed at a bottom portion 44 when vertically oriented.

According to the sixth embodiment, the bottom portion 44 when the waste ink collecting device 20F is vertically oriented as shown in FIG. 7B (i.e., the left-hand side portion when horizontally oriented as shown in FIG. 7A) is configured such that a separating portion of the upper cover 42 and the ink tank 21 and/or the pivot for rotatably supporting the upper cover 42 are not provided at the bottom portion 44. Further, the bottom portion 44 including a side wall and upper wall when oriented horizontally is integrally formed having no gaps/openings so that the ink will not leak from the waste ink collecting device 20F when oriented vertically.

Seventh Embodiment

Figure 8:
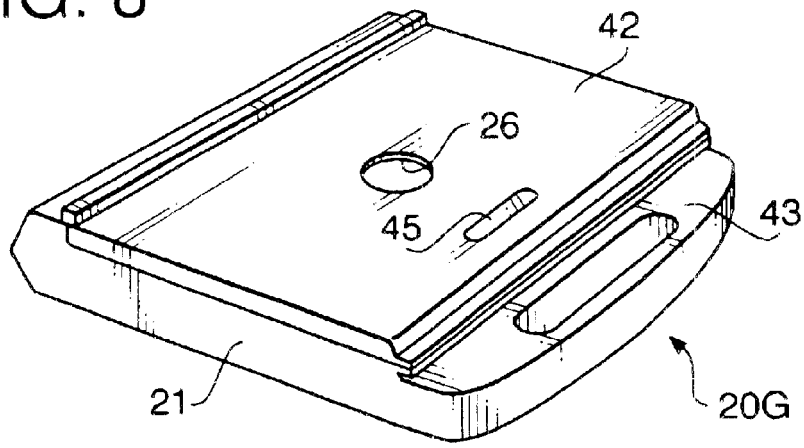
FIG. 8 is a perspective view of the waste ink collecting device according to a seventh embodiment.
Figure 9:
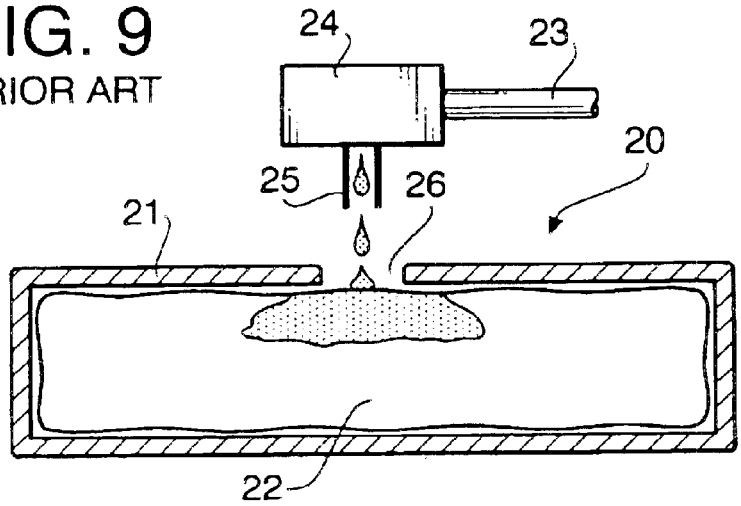
FIG. 9 PRIOR ART
FIG. 9 is a cross-sectional view of a conventional waste ink collecting device.
Figure 10:
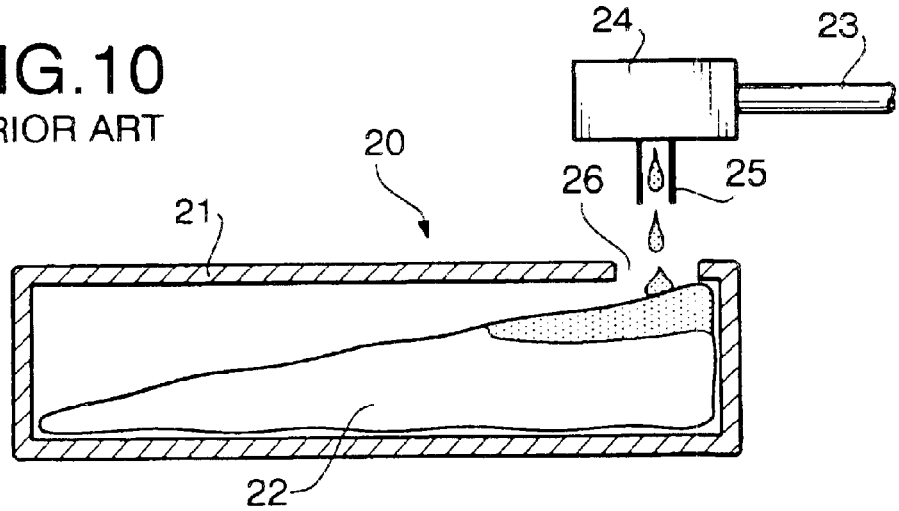
FIG.10 PRIOR ART
FIG. 10 is a cross-sectional view of another conventional waste ink collecting device.

FIG. 8 is a perspective view of the waste ink collecting device 20G according to a seventh embodiment of the invention. In this embodiment, a window 45 which allows a user to observe the absorber 22 is formed on the upper surface (preferably at a portion close to the front side thereof) of the waste ink collecting device 20G. By forming the window 45, even when the ink-jet printer is in use, only by withdrawing the waste ink collecting device 20G when the waste ink is not being dropped, the user can check the absorbing condition of the ink absorber through the window 45. For example, if the upper surface of the ink absorber 22 appears to be well permeated with the ink, the user can judge that the ink absorber 22 should be exchanged shortly. Thus, the user can prepare for the exchange of the ink absorber 22 in advance.

It should be noted that the window 45 may be replaced with another structure. For example, the waste ink collecting device 21 or the upper cover 42 thereof may be formed of transparent or semi-transparent member.

Alternatively or optionally, a photo sensor or a moisture sensor may be provided above the ink absorber 22 to detect that the ink absorbed from the bottom surface of the ink absorber 22 has reached the upper surface thereof.

It should be noted that various features are described as different embodiments. The invention need not be limited to respective embodiments. Rather, any suitable combination of the features of various embodiments is also considered to be included a scope of the invention.

The present disclosure relates to the subject matter contained in Japanese Patent Application No. 2002-121682, filed on Apr. 24, 2002, which is expressly incorporated herein by reference in its entirety.

What is claimed is:

1. A waste ink collecting device that collects unnecessary ink discharged from a printhead of an ink-jet printer, comprising:

an ink tank;

an ink absorber accommodated in said ink tank, said ink absorber absorbing the unnecessary ink discharged from the printhead of the ink-jet printer, an inlet of the dropped ink being formed on a top plate of said ink tank, the discharged ink being dropped into said ink tank, the dropped ink entering said ink tank through said inlet; and a partition wall provided in said ink tank, said partition wall defining a passage through which the dropped ink flows to an inner bottom surface of said ink tank, said partition wall preventing the dropped ink from directly striking the ink absorber and substantially separating an area of the ink tank within which the ink absorber is accommodated from the passage, wherein the ink dropped on the inner bottom surface of said ink tank is absorbed by said ink absorber through a bottom surface thereof.

2. The waste ink collecting device according to claim 1, wherein said partition wall is protruded downward from an inner surface of a top plate of said ink tank.

3. The waste ink collecting device according to claim 2, wherein a waste ink outlet is formed at a lower portion of said partition wall, the passage defined inside said partition wall communicating through said waste ink outlet with an area outside said partition wall and on the inner bottom surface of said ink tank.

4. The waste ink collecting device according to claim 3, wherein a clearance is formed between the inner bottom surface of said ink tank and a lower end surface of said partition wall, said clearance serving as said waste ink outlet.

5. The waste ink collecting device according to claim 4, wherein a plurality of ribs are formed on the inner bottom surface of said ink tank such that one end of each rib is located in the vicinity of an area where the ink is dropped, each of said plurality of ribs extending toward peripheral area of the inner bottom surface.

6. The waste ink collecting device according to claim 1, wherein said partition wall is protruded upward from an inner bottom surface of said ink tank.

7. The waste ink collecting device according to claim 6, wherein at least one waste ink outlet opening is formed on a lower portion of said partition wall, the passage defined inside said partition wall communicating through said at least one waste ink outlet opening with an area outside said partition wall and on the inner bottom surface of said ink tank.

8. The waste ink collecting device according to claim 7, wherein a plurality of ribs are formed on the inner bottom surface of said ink tank such that each of said plurality of ribs extends from an outer surface of said ink tank toward a peripheral area of the inner bottom surface.

9. The waste ink collecting device according to claim 1, wherein a plurality of ribs are formed on the inner bottom surface of said ink tank such that one end of each rib is located in the vicinity of an area where the ink is dropped, each of said plurality of ribs extending toward peripheral area of the inner bottom surface.

10. The waste ink collecting device according to claim 9, wherein said ink tank is provided with an openable upper cover, a plurality of pressing ribs being formed on an inner surface of said upper cover at positions corresponding to said plurality of ribs formed on the inner bottom surface of said ink tank, said plurality of pressing ribs compressing said ink absorber in association with said plurality of ribs when said upper cover is closed, the compression being released when said upper cover is opened.

11. The waste ink collecting device according to claim 9, wherein at least an area of the inner bottom surface of said ink tank where the ink is dropped is formed to have a higher level than an other area of the inner bottom surface.

12. The waste ink collecting device according to claim 1, wherein said ink tank is provided with an openable upper cover, said upper cover comprising said ink absorber when said upper cover is closed, the compression being released when said upper cover is opened.

13. The waste ink collecting device according to claim 1, wherein said ink tank is formed with at least an area which allows a user to observe a condition of said ink absorber.

14. The waste ink collecting device according to claim 13, wherein said at least an area includes a transparent or semi-transparent window formed on said ink tank.

15. The waste ink collecting device according to claim 14, where said ink tank is formed of transparent or semi-transparent material.

16. A waste ink collecting device that collects unnecessary ink discharged from a printhead of an ink-jet printer, comprising:

an ink tank;

an ink absorber accommodated in said ink tank, said ink absorber absorbing the unnecessary ink discharged from the printhead of the ink-jet printer, an inlet of the dropped ink being formed on a top plate of said ink tank, the discharged ink being dropped into said ink tank, the dropped ink entering said ink tank through said inlet; and a partition wall provided in said ink tank, said partition wall defining, inside the partition wall, a passage of the ink entered through said inlet to an inner bottom surface of said ink tank, said partition wall preventing the dropped ink from directly striking the ink absorber, the ink dropped on the inner bottom surface of said ink tank being absorbed by said ink absorber through a bottom surface thereof, wherein at least an area of the inner bottom surface of said ink tank where the ink is dropped is formed to have a higher level than an other area of the inner bottom surface.

17. The waste ink collecting device according to claim 16, wherein the inner bottom surface is configured such that a portion closer to the area where the ink is dropped has a higher level and a portion closer to the peripheral end of the inner bottom surface has a lower level, the level changing continuously.

18. The waste ink collecting device according to claim 16, wherein the inner bottom surface is configured such that a portion closer to the area where the ink is dropped has a higher level and a portion closer to the peripheral end of the inner bottom surface has a lower level, the level changing stepwise.

19. The waste ink collecting device according to claim 16, wherein a protruded portion is formed at the area of the inner bottom surface of said ink tank where the ink is dropped.

20. A waste ink collecting device that collects unnecessary ink discharged from a printhead of an ink-jet printer, comprising:

an ink tank;

an ink absorber accommodated in said ink tank, said ink absorber absorbing the unnecessary ink discharged from the printhead of the ink-jet printer, an inlet of the dropped ink being formed on a top plate of said ink tank, the discharged ink being dropped into said ink tank, the dropped ink entering said ink tank through said inlet; and a partition wall provided in said ink tank, said partition wall defining, inside the partition wall, a passage of the ink entered through said inlet to an inner bottom surface of said ink tank, said partition wall preventing the dropped ink from directly striking the ink absorber, the ink dropped on the inner bottom surface of said ink tank being absorbed by said ink absorber through a bottom surface thereof, wherein said ink tank is provided with an upper cover which is openable with respect to a main body of said ink tank, wherein borders between said main body of said ink tank and said upper cover being located at positions spaced from a bottom portion when the ink tank is oriented vertically so as to prevent leakage of the ink pooled at the bottom portion.

21. The waste ink collecting device according to claim 20, wherein said upper cover is pivoted by said ink tank so that a distal end of said upper cover swings to open/close said main body, said borders including a position of said distal end of said upper cover when closed and a position where said upper cover is pivoted.

22. The waste ink collecting device according to claim 20, further includes a handle provided on said ink tank.

23. The waste ink collecting device according to claim 20, wherein said upper cover compresses said ink absorber when said upper cover is closed, the compression being released when said upper cover is opened.

* * * * *